US007798382B2

(12) United States Patent
Zentgraf et al.

(10) Patent No.: US 7,798,382 B2
(45) Date of Patent: Sep. 21, 2010

(54) REGULATING THE WEB TENSION OF A CONTINUOUS MATERIAL

(75) Inventors: Christian Zentgraf, Aschaffenburg (DE); Stephan Schultze, Lohr am Main (DE)

(73) Assignee: Bosch Rexroth AG, Stuttgart (DE)

( * ) Notice: Subject to any disclaimer, the term of this patent is extended or adjusted under 35 U.S.C. 154(b) by 307 days.

(21) Appl. No.: 11/563,055

(22) Filed: Nov. 24, 2006

(65) Prior Publication Data

US 2007/0119894 A1 May 31, 2007

(30) Foreign Application Priority Data

Nov. 29, 2005 (DE) ..... 10 2005 056 802

(51) Int. Cl.
*B23Q 15/00* (2006.01)

(52) U.S. Cl. ..... 226/44; 226/42

(58) Field of Classification Search ..... 242/416, 242/417.3, 419.5; 226/10, 24, 42, 44
See application file for complete search history.

(56) References Cited

U.S. PATENT DOCUMENTS 5,480,085 A * 1/1996 Smithe et al. ..... 226/44
5,996,492 A * 12/1999 Jurkewitz et al. ..... 101/228
6,106,177 A 8/2000 Siegl et al.
6,499,639 B2 12/2002 Cote et al.

FOREIGN PATENT DOCUMENTS

| | | | |
|---|---|---|---|
| DE | 3143545 | A1 * | 5/1983 |
| DE | 198 34 725 | | 2/2000 |
| DE | 102 01 993 | | 8/2002 |
| DE | 103 22 098 | | 12/2004 |

OTHER PUBLICATIONS

Machine Translation of DE 3143545 A1.*

* cited by examiner

*Primary Examiner*—John Q Nguyen
*Assistant Examiner*—William E Dondero
(74) *Attorney, Agent, or Firm*—Michael J. Striker

(57) ABSTRACT

A method for regulating a web tension of a continuous materials which is moving using a transport device with a web-tension controller, includes determining controller characteristic parameters, and using for the determining of controller characteristic parameters a characteristic which is specifiable as a function and/or at several support points.

17 Claims, 2 Drawing Sheets

REGULATING THE WEB TENSION OF A CONTINUOUS MATERIAL

CROSS-REFERENCE TO A RELATED APPLICATION

The invention described and claimed hereinbelow is also described in German Patent Application DE 10 2005 056 802.5 filed on Nov. 29, 2005. This German Patent Application, whose subject matter is incorporated here by reference, provides the basis for a claim of priority of invention under 35 U.S.C. 119(a)-(d).

BACKGROUND OF THE INVENTION

The present invention relates to a method for regulating the web tension of a continuous material which is moved using a transport device with a web-tension controller, with determination of controller characteristic parameters.

"Continuous material" refers to continuous webs of paper, film or cloth. For processing, the continuous material is conveyed inside a transport device using drive rollers and it is printed on, for example. According to the related art, the continuous material is fed to a processing stage using a feed nip, which is composed of a rotational-speed controlled drive roller with an associated nip roller. After the processing stage, the continuous material is carried away using a second nip, which is composed of a rotational-speed controlled drive roller with an associated nip roller. A sufficient processing quality can be attained only when the continuous material has a certain minimum web tension between the nips, because it would otherwise be transported inexactly for processing and could tend to flutter, for example. On the other hand, a certain maximum web tension must not be exceeded, because the continuous material would then tear or stretch inelastically.

To ensure smooth operation of the transport device and good quality of the continuous material which is processed, the web tension must be held within a certain range, depending on the speed and parameters, such as the elasticity module of the continuous material.

A PI controller which uses the forward slip or lag of the drive roller assigned to the feed or carry-away nip as the manipulated variable is used as the web-tension controller. The control loop is closed by measuring the actual value of the web tension using a load cell. The controller characteristic parameters of the tension controller with load cell are dependent on the machine speed and the material. The speed dependence can be modelled using an adaptive characteristic of the P portion of the controller. The material dependence of the advantageous web-tension control can be taken into account via an optimization step during start-up. The disadvantage of this is that the optimization step must be repeated when the material is replaced. If harder material is installed, for example, the control loop can become instable. When the first optimization is selected such that suitable parameters are selected for a larger group of materials, the control-loop dynamics are not fully utilized for more flexible materials. This unnecessarily increases the amount of time required to set a suitable web tension and results in an increased quantity of incorrectly processed continuous material.

Publication DE 198 34 725 A1 makes known a controller and a method for regulating the tension of a paper web in a printing press, with which a measured web-tension actual value is sensed within the controlled system. A speed setpoint value and a web-tension setpoint value are specified. Forward slip and lag setpoint values are determined based on the web-tension setpoint value and the web-tension actual value which, combined with the speed setpoint value, defines the speed to be set. With this web-tension control, the deviation of individual web tensions at different points of the paper path can be held within certain limits. Although the publication addresses the influence of the elasticity module of the continuous material on the print properties, it does not provide teaching for eliminating the influence by taking the controller characteristic parameters into account.

Publication DE 102 01 993 A1 makes known a device and a method for the dynamic control of a drive for transport rollers in a web press. The task was to ensure a desired web tension and a required print quality in different phases of machine operation. The web tension of a section of a continuous material is controlled between a feed nip and a carry-away nip, each of which includes a transport roller and a nip roller. During a first phase of the printing press operation, the control device functions in a web-tension control mode to keep the web tension at a first desired web-tension value. In a second phase of the operation of the printing press, control is carried out in a speed-control mode, in which the ratio of drive speeds of the feed nip and the carry-away nip is controlled.

Publication DE 103 22 098 makes known a controller for the web speed of a continuous material, with which a setpoint value for the web speed is determined with consideration for the actual value of the web tension and the elasticity module of the web material.

The disadvantage of the related art is the fact that the web-tension control must be adapted to the continuous material to be used, and it cannot be used universally.

SUMMARY OF THE INVENTION

The object of the present invention is to create a method for controlling a web tension of a continuous material that makes it possible to increase product quality with a high production volume and minimal effort required to change the type of continuous material.

The object is attained by the fact that the controller characteristic parameters of the web-tension controller are determined according to a characteristic which is specifiable as a function and/or at several support points. As a result, the web tension can be held within an increased operating range of the transport device, and the properties of different web materials, e.g., widths and thicknesses of the continuous material, can be held within the range which is advantageous for the processing quality.

When PI control or PID control is carried out with the web-tension controller, simple and economical web-tension control can be realized, which also enables good processing quality to be attained.

When the proportional and/or integral and/or differential portion of the PI controller or PID controller is used as the controller characteristic parameter, the web tension can be held in the range which is suitable for good processing quality over a wide range of parameters of the continuous material.

According to an embodiment of the present invention which is particularly suited for rapid and exact control of the web tension of the continuous material, the drive of the transport device takes place in at least two drive groups which are driven by separate drives, the coupling of which takes place electronically within the control and drive system. This embodiment, which is also referred to as "shaftless" drive, does not couple the at least two drive groups mechanically via a rigid shaft, but rather electronically via the web-tension controller or another control system. They can act on servo synchronous motors and thereby, e.g., also provide different start-up and control characteristics for two drives. In this manner, e.g., inertias of components of the transport device can be taken into account for the continuous material.

When the drives are controlled using a real or virtual master axis, the control and regulation of the transport device can be based on one of the actual drive axes, or the controller parameters for the drive axes are based on a virtual master axis which exists only in the parameters of the web-tension controller. When a virtual master axis is used, inaccuracies in measured value detection and/or the motion of the master axis do not affect the control quality.

The time constant of the controlled system is proportional to the reciprocal value of the speed of the continuous material. It is therefore advantageous when the controller characteristic parameters are determined as a function of the master axis speed of the continuous material according to a hyperbolic characteristic.

In a particularly easily realizable embodiment, the control-loop parameters are determined depending on the master axis speed according to a characteristic which is composed of piecewise functions.

A specified setpoint value of the web tension can be attained more quickly and, therefore, with less production failure, by determining the controller characteristic parameters according to a characteristic which is specifiable as a function and/or at several support points depending on a deviation of the web tension based on a specifiable setpoint value.

When the controller characteristic parameters are determined according to a characteristic which is specifiable as a function and/or at several support points depending on the running length of the continuous material between a feed nip and a carry-away nip, a set of controller characteristic parameters which is suitable for a smooth production run can be made available when the transport device is switched over and the length of the continuous material between the feed nip and the carry-away nip is changed.

When constant values are specified for the controller characteristic parameters below a minimum speed of the machine, system or continuous material, and above a maximum speed of the machine, system or continuous material, a steep characteristic with good control characteristics can be selected in the normal operating range of control without the continuous material and/or transport device becoming damaged if operation takes place outside of the usual operating range.

When the controller characteristic parameters are determined depending on physical characteristic values of the continuous material, good processing quality can be attained when different materials are used. In particular, fluctuations in the physical characteristic values over time can be detected and taken into account.

When the physical characteristic values are determined inside the transport device, changes that occur during ongoing operation can be taken into account quickly, thereby reducing the portion of continuous material which must be discarded.

High production speed and processing quality can be attained when different materials are used and when the width and/or thickness of the continuous material differs by using the elasticity modulus of the continuous material as the physical characteristic value. When the elasticity modulus is measured continually, a change in the elasticity modulus—which is also dependent on the drying behavior and/or moisture level of the continuous material—can be taken into account.

According to an economical embodiment, the elasticity modulus is determined using the primary detector, rotation-angle sensor, and web-tension controller, which are provided anyway in the transport device according to the related art. They can be used to determine the elasticity modulus without using any additional devices and, therefore, at no additional cost.

According to a particularly simple embodiment, the elasticity modulus is determined based on a change in the length of the continuous material as a function of a change in web tension. It is possible to extend the length of the continuous material by a certain fixed amount and measure the resultant change in web tension, or to increase the web tension by a certain fixed amount and measure the resultant change in length.

High processing quality of a continuous material can be attained, even when acceleration and braking are carried out, by determining the controller characteristic parameters as a function of the inertia of non-driven rollers between the feed nip and the carry-away nip. The disturbing influence of these non-driven guide rollers on the web tension in the processing region can be reduced in this manner.

The start-up period of the web-tension controller can be shorted by providing default values for the controller characteristic parameters as starting values for the manipulated variables, such as forward slip or lag of a drive, and self-optimization of the PI controller or PID controller. As a result, the portion of product with good processing quality can be improved.

When the default values for the manipulated variables are determined based on the physical characteristic values of the continuous material which were determined, a set of default values can also be determined for different and new types of materials and material combinations of continuous material, with which optimal controller characteristic parameters can be quickly obtained.

When an additive speed setpoint value, a rotational-speed setpoint value, a speed factor or a rotational-speed factor of the transport device is used as the manipulated variable, a particularly simply designed web-tension controller can be realized, which still meets the requirements for high processing quality.

When a cycle time based on a machine speed is taken into account in the web-tension controller, the web tension remains within the limits required for high processing quality even at low speeds of the continuous web. With this, the effect of a continual PD controller is prevented, which continues at low speeds and when the integral part is at a standstill, and which can drive the manipulated variable out of the suitable range.

The novel features of which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
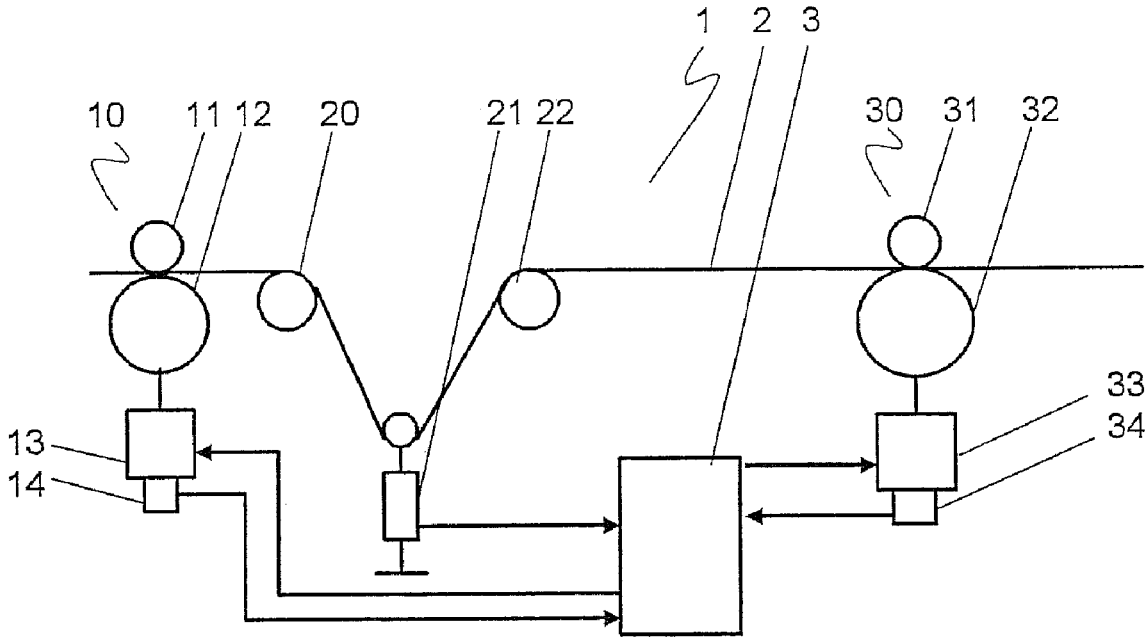
FIG. 1 shows a transport device for a continuous material in accordance with the present invention.

FIG. 1 shows a transport device 1 for processing a continuous material 2 between a feed nip 10 and a carry-away nip 30 with a web-tension controller 3. At feed nip 10, continuous material 2 is clamped between a nip roller 11 and a drive roller 12, and it is fed at a defined speed for processing. The processing can be, e.g., printing. Drive roller 12 is driven by motor 13, the rotational speed and angular position of which are sensed using a rotation-angle sensor 14 and which are supplied to web-tension controller 3. Web-tension controller 3 controls the supply voltage of motor 13 and is designed as a PI controller.

After processing, continuous material 2 is moved at a carry-away nip 30 using a nip roller 31 and a drive roller 32. Drive roller 32 is driven by motor 33, the shaft of which is coupled with a rotation-angle sensor 34, which supplies data about the rotational motion of motor 33 to web-tension controller 3. In another embodiment, the drive of drive rollers 12, 32 can be carried out using servo synchronous motors, which, due to their mode of operation, make the use of rotational angle sensors 14, 34 superfluous. In this case, the rotational speed and rotation angle of motors 13, 33 is controlled via the phase and frequency of the supply voltage.

The actual value of the web tension between feed nip 10 and carry-away nip 30 is measured with a primary detector. To this end, continuous material 2 is fed via a guide roller 20 to primary detector 21, and is moved further via a second guide roller 22 for further processing. Primary detector 21 can be designed, e.g., as a load cell. Its output signal is supplied to web-tension controller 3 as the actual value of the web tension.

Figure 2:
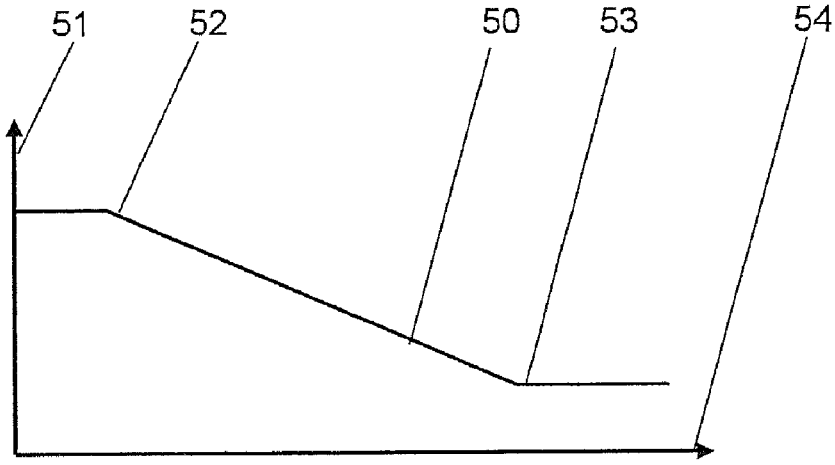
FIG. 2 shows a characteristic for speed-adaptive control in accordance with the present invention.

FIG. 2 shows a characteristic 50 for speed-adaptive control. Characteristic 50 is the graph of P amplification 51 versus master axis speed 54. Master axis speed 54 is the circumferential speed of a drive roller 12, 22 or a drive roller located in front or behind it in transport device 1 along continuous material 2. In another embodiment, master axis speed 54 can also refer not to an actual axis, but to a calculated variable in web-tension controller 3; in this case, the master axis is referred to as a "virtual master axis".

Web-tension controller 3 bases the control and regulation of other drives on master axis speed 54. Characteristic 50 is selected such that P amplification 51 is constant below a first operating point 52 and above a second operating point 53. As such, in the usual operating range between first operating point 52 and second operating point 53, a steep characteristic with rapid compensation for deviations can be selected, but, outside of the range, web-tension values which do not damage continuous material 2 can be maintained.

Figure 3:
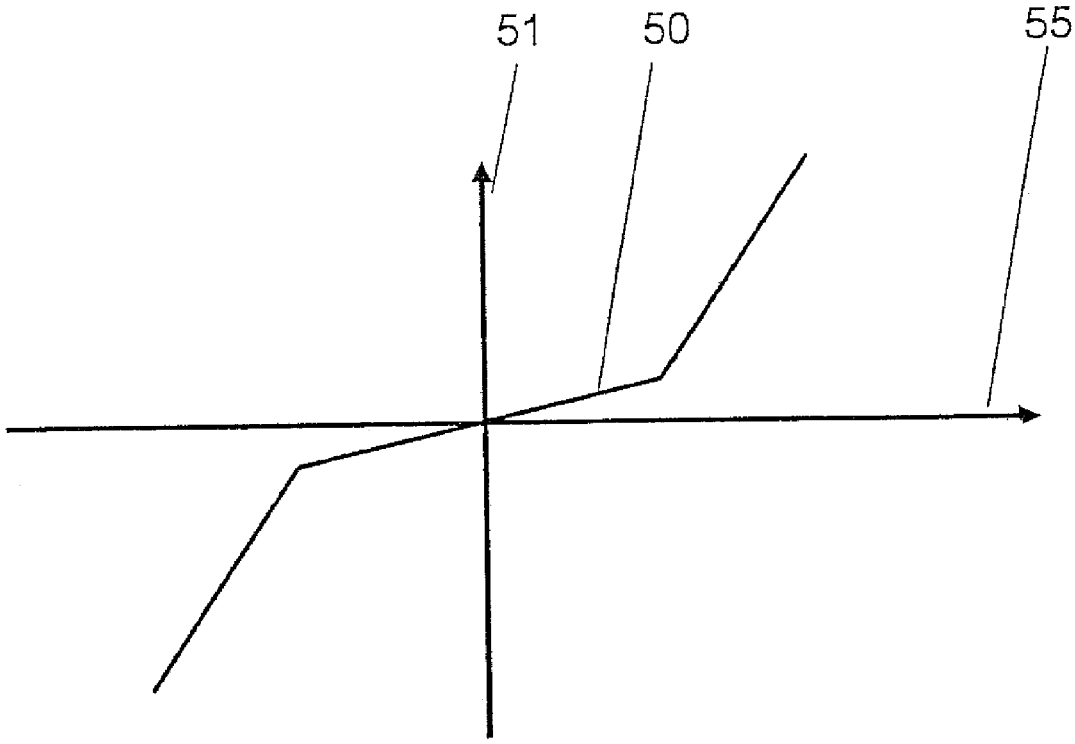
FIG. 3 shows a characteristic for control which depends on deviations from control in accordance with the present invention.

FIG. 3 shows a characteristic 50 which specifies a P amplification 51 which depends on a control deviation 55. In this embodiment, a flat characteristic 50 is provided when the deviations from the setpoint value are slight, and a steep characteristic 50 is provided when the deviations are greater. As a result, when deviations are slight, continuous material 2 runs smoothly and the processing quality is very high. When the deviations are greater, the web tension is quickly adapted to the setpoint value.

It will be understood that each of the elements described above, or two or more together, may also find a useful application in other types of constructions differing from the type described above.

While the invention has been illustrated and described as embodied in a regulating the web tension of a continuous material, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for regulating a web tension of a continuous material moving with a transport device, comprising the steps of:

determining a master axis speed based on a speed of a drive element in a point of feed of the continuous material and on a speed of a drive element in a point of carry-away of the continuous material;

determining a material physical characteristic in a point between the material feed point and the material carry-away point by a primary detector;

determining the web tension of the continuous material by a web tension controller based on the determined master axis speed and the material physical characteristic; and using the web tension determined by the web tension controller to regulate the web tension by the web tension controller so as to hold the web tension within an increased operating range of the transport device and to hold properties of the web material within a range which is appropriate for a processing quality, wherein the web tension has an amplification as a function of a deviation from a predetermined setpoint value for the web tension, wherein a change of amplification has a flat characteristic when the deviation from the setpoint value is less than a preselected maximum value, and wherein the change of amplification has a steep characteristic when the deviation from the setpoint value reaches or exceeds the preselected maximum value, so that when said amplification has said flat or steep characteristic, the web tension controller is adapted automatically to control the web tension to the setpoint value according to said amplification.

2. A method as defined in claim 1; and further comprising providing a control function selected from the group consisting of a PI control function and PID control function and carrying out the control function using the web-tension controller.

3. A method as defined in claim 2; and further comprising using as the web tension a portion selected from the group consisting of a proportional portion, an integral portion, and differential portion of the web tension controller which is a PI controller or a PID controller.

4. A method as defined in claim 3; and further comprising specifying default values for the web tension as starting values for the web tension controller which is the PI controller or the PID controller.

5. A method as defined in claim 2; and further comprising taking into account in the web-tension controller a cycle time based on a machine speed.

6. A method as defined in claim 1; and further comprising driving of the transport device in at least two drive groups, wherein said at least two drive groups are driven by separate drives with a coupling taking place electronically within a control and drive system.

7. A method as defined in claim 6; and further comprising controlling the drives using a master axis selected from the group consisting of a real master axis and a virtual master axis.

8. A method as defined in claim 1; and further comprising determining the web tension as a function of a speed selected from the group consisting on a machine speed, a system speed and a continuous material speed.

9. A method as defined in claim 1; and further comprising determining the web tension as a function of a speed selected from the group consisting of a machine speed, a system speed, and a continuous material speed according to a characteristic composed of piecewise functions.

10. A method as defined in claim 1; and further comprising determining the web tension as a function of a deviation of a web tension value from a specifiable setpoint.

11. A method as defined in claim 1; and further comprising determining the web tension according to a characteristic which is a function of a running length of the continuous material between and incoming nip and an outgoing nip.

12. A method as defined in claim 1; and further comprising specifying constant values for the web tension below a minimum speed selected from the group consisting of a minimum speed of a machine, a system, and a continuous material, and an above-maximum speed selected from the group consisting of a speed of the machine, the system, and the continuous material.

13. A method as defined in claim 1; and further comprising using an elasticity modulus of the continuous material as the physical characteristic value.

14. A method as defined in claim 13; and further comprising determining the elasticity modulus as a function of a change in web tension based on a change in a length of the continuous material.

15. A method as defined in claim 1; and further comprising determining the web tension as a function of an inertia of non-driven rollers between a feed nip and a carried-away nip.

16. A method as defined in claim 1; and further comprising determining default values for manipulated variables from physical characteristic values of the continuous material which were determined.

17. A method as defined in claim 16; and further comprising using as a manipulated variable a variable selected from the group consisting of an additive speed setpoint value, a rotational-speed setpoint value, a speed factor of the transport device and a rotational speed factor of the transport device.

* * * * *